US007987784B2

(12) United States Patent
Daniel et al.

(10) Patent No.: US 7,987,784 B2
(45) Date of Patent: Aug. 2, 2011

(54) PRINTING SYSTEM EMPLOYING DEFORMABLE POLYMER PRINTING PLATES

(75) Inventors: Jurgen H. Daniel, San Francisco, CA (US); Dirk De Bruyker, Palo Alto, CA (US); David K. Fork, Los Altos, CA (US); Christopher L. Chua, San Jose, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 613 days.

(21) Appl. No.: 11/613,141

(22) Filed: Dec. 19, 2006

(65) Prior Publication Data

US 2008/0141884 A1 Jun. 19, 2008

(51) Int. Cl.
*B41N 1/10* (2006.01)
*B41N 6/00* (2006.01)

(52) U.S. Cl. ..... 101/395; 101/401.1

(58) Field of Classification Search ..... 101/395, 101/401.1

See application file for complete search history.

(56) References Cited

U.S. PATENT DOCUMENTS

| | | | | |
|---|---|---|---|---|
| 5,760,808 | A | 6/1998 | Wiedemer | |
| 6,092,465 | A | 7/2000 | Agronin | |
| 6,234,079 | B1 * | 5/2001 | Chertkow | 101/395 |
| 6,294,308 | B1 * | 9/2001 | Caspar et al. | 430/200 |
| 6,655,281 | B1 * | 12/2003 | Jordan et al. | 101/382.1 |

FOREIGN PATENT DOCUMENTS

| | | | |
|---|---|---|---|
| JP | 2005343051 | | 12/2005 |
| WO | WO 02051639 | A2 * | 7/2002 |

OTHER PUBLICATIONS

Hirata, Susumu; Yorishige, Ishii; Matoba, Hirotsugu; and Inui, Tetsuya; "An Ink-Jet Head Using Diaphragm Microactuator," MEMS 1996 IEEE Proceedings on the Ninth International Workshop on Microelectromechanical Systems, pp. 418-423.

* cited by examiner

*Primary Examiner* — Joshua D Zimmerman
*Assistant Examiner* — Shema T Freeman
(74) *Attorney, Agent, or Firm* — Marger Johnson & McCollom, P.C.

(57) ABSTRACT

A printing plate has a substrate, an array of cells on the substrate, wherein each cell corresponds to an element of a print image, a deformable polymer material localized into the cells such that each cell is at least partially formed from the deformable polymer material, a reservoir corresponding to each cell to collect the deformable polymer material as needed when the deformable polymer material is one of either melted or softened, and a heater to cause the deformable polymer material to either melt or soften. A method of forming a printing plate provides an array of cells, first heats the array of cells such that the deformable polymer material does one of either melts or softens, actuates the cells in the array to assume a deformed state, cools the array of cells to solidify the cells in the deformed state, second heats the cells such that the deformable polymer material in selected ones of the cells does one of either soften or melt and return to a less deformed state to form a printing pattern, and cools the surface to solidify the deformable polymer material in the printing pattern. A method of forming a printing plate provides an array of cells, heats the array of cells such that the deformable polymer material softens, actuates selected ones of the cells to deform surfaces of the selected ones to form a printing pattern, and cools the array of cells to solidify the printing pattern into a printing plate.

8 Claims, 6 Drawing Sheets

PRINTING SYSTEM EMPLOYING DEFORMABLE POLYMER PRINTING PLATES

BACKGROUND

Gravure, flexography and offset printing are high speed printing processes that result in high quality printed images. The high speed results from the 'stamping' nature of these processes, where a printing surface has areas such as wells in the case of gravure, raised features in flexography and ink accepting and repelling areas in offset printing that form the printing pattern. After the inking process, the ink is transferred from the printing pattern to a printing substrate such as a piece of paper to form the print image. High quality prints may be achieved using high viscosity inks with high pigment loading and due to printing at high pixel or ink dot density.

In gravure printing, the printing surface such as a printing plate has wells formed in the areas needed to form the desired image. The surface receives the ink and a blade removes any excess, so that the ink is captured only in the wells. The system then applies a high contact pressure to the printing surface against a printing substrate to transfer the ink to the printing substrate. A printing substrate may include paper, transparency, foils, plastics, etc. Generally, due to the high contact pressure necessary, gravure printing processes print to paper or relatively sturdy substrates.

In flexographic printing, the process has many similar steps, except that the system raises the wells, or inked pixels, above the surface. Ink transfer occurs with less force, so the process can use 'softer' printing plates made out of rubber or other elastomers more appropriate for printing substrates or media other than paper, such as transparencies, foil, labels, plastic, etc.

Flexographic and gravure printing processes have relatively high costs. The cost of the system as well as the cost of manufacturing the printing surfaces, also referred to as masters or printing plates, result in these processes only being used for high volume printing applications. An ability to manufacture less expensive masters and a method to utilize them would allow more applications to take advantage of the high quality and high speed of flexographic and gravure printing.

SUMMARY

One embodiment is a printing plate formed from a substrate and an array of cells on the substrate, wherein each cell corresponds to an element of a print image. The cells have a deformable polymer material localized into the cells such that each cell is at least partially formed from the deformable polymer material and a reservoir corresponding to each cell to collect the deformable polymer material as needed when the deformable polymer material is softened.

Another embodiment is a method of forming a printing plate that includes providing an array of cells with deformed surfaces, heating the cells such that the deformable polymer material in selected ones of the cells softens and returns to a less deformed state to form a printing pattern from unselected ones of the cells, and cooling the surface to solidify the deformable polymer material in the printing pattern.

Another embodiment is a method of forming a printing plate that includes providing an array of cells of deformable polymer material, heating the array of cells such that the deformable polymer material softens, actuating selected ones of the cells to deform surfaces of the selected ones to form a printing pattern, and cooling the array of cells to solidify the printing pattern into a printing plate.

DETAILED DESCRIPTION

Figure 1:
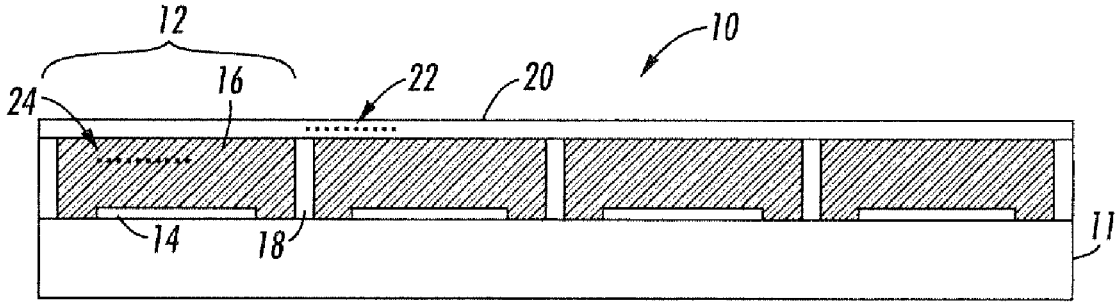
FIG. 1 shows an example of an array of cells having deformable polymer material.

FIG. 1 shows an example of an array of cells 10 having deformable polymer material used to create a printing plate. Control of the phase of the deformable polymer material coupled with various selection processes allows the array of cells to form a printing pattern, where the printing pattern, when inked and transferred to a printing substrate, forms the print image. The printing plate is the surface or component upon which the print image that is to be inked is formed, such as a gravure plate, a flexography plate, or an offset print plate. The print image may be positive or negative. Typically, printing plates are attached to a cylinder in the printing press and may be referred to as having a cylindrical structure, whether the plates form a complete cylinder or merely a portion, such as a half cylinder. Ink is applied to the plate's image area and transferred directly to the paper or to an intermediary cylinder and then to the paper.

The printing plate, in gravure printing, will have wells that trap ink for subsequent transfer to a printing substrate. In flexography, the raised areas of the printing pattern receive the ink for transfer to the printing substrate. Selecting cells to deform downwards or inwards relative to a planar surface of the printing plate or to deform outwards or upwards from the planar surface forms the printing pattern.

The array of cells 10 in FIG. 1 may contain a deformable polymer material within them. The term cell as used here means a localized region of the deformable polymer material possibly corresponding to a pixel of a final print image. A layer of patterned material with wells or depressions may form the boundaries of the cells. The layer may be referred to as walls, spacers or a spacer layer. Generally, the patterned material will have a low thermal conductivity to provide thermal isolation between the cells. If used, the pattern of cells may be formed by plating, by a photopolymer that is imaged with the pattern, cured and etched to remove material to form the wells, by a molding process, by etching or machining wells out of the substrate or by other known microfabrication methods. The cells may also be localized regions that do not use walls, being localized regions in a continuous layer of the deformable polymer material. In one embodiment the cells are localized by corresponding to a pixel of a final print image']

The array 10 of FIG. 1 provides only one example. Several variations on this structure will appear in later figures. These variations will apply to all of the structures discussed here as well as any structures within the scope of the claims. For example, some structures in later figures do not have a membrane. The structure of FIG. 1 does not need to have a membrane. Similarly, later figures may have other structures such as reservoirs; any of the structures shown may include reservoirs, some may not use walls or spacers.

The deformable polymer material may include any polymeric material that softens or in particular becomes malleable or a polymeric material that melts when heated. Examples include waxes and thermoplastics such as paraffin wax, carnauba wax, polyolefin EG8150 and EG8200 from Dow Plastics, EPON SU-8 polymer from Shell Chemicals and many others. Waxes include a wide range of materials such as natural waxes, mineral waxes, petroleum waxes or synthetic waxes for example, In general, the deformable polymer materials have a glass transition temperature, $T_g$, that is lower than the melting temperature. Thermoplastic polymers and waxes become rigid below $T_g$, and above $T_g$, they become soft, and may be rubbery and capable of elastic or plastic deformation without fracture and at higher temperatures they typically melt. Many waxes are particular attractive because of their low melt viscosity. Possible are also blends of waxes with other thermoplastic materials such as DuPont Elvax® and wax blends, for example. This range of materials is part of the deformable polymer materials and waxes will be considered thermoplastic polymers for purposes of discussion here.

Non-cross-linked polymers will transition between these states, but cross-linked polymers will generally become brittle, once below $T_g$, and will shatter rather than deform. Generally, the deformable polymer material used here will fluctuate between liquid or soft and hard, depending upon the temperature. In some instances the material may turn to liquid, in others it will soften to the point of being plastically deformable, but does not turn to liquid. In either case, application of heat causes the material to become deformable.

In FIG. 1, the deformable polymer material may completely or only partially fill the wells. In this particular example, cells such as 12 have an actuator 14 under the deformable polymer material 16, and a membrane 20 that covers the array of cells. The cell walls or spacers such as 18 lay on the substrate 11 and support the membrane 20 and create local regions, or cells, of the deformable polymer material for individualized control. Prior to heating above $T_g$ or Tm, the membrane on top of the cells is stretched flat across the cells. This will be referred to here as the planar state. The membrane may be a vapor deposited polymer membrane such as a parylene membrane or an elastomeric membrane such as a thin silicone membrane which may be deposited by spray coating, extrusion coating, dip-coating or other commonly known coating techniques. It also may be a laminated membrane. Depending on the size of the cells and therefore the resolution it may be only a few micrometers or even submicron thin. However for lower resolution application the membrane may be thicker.

The deformable polymer material may include particles such as 24 that assist in heating the deformable polymer material or actuation of the deformable polymer material when heated. Examples of the particles include magnetic particles and radiation absorbing particles, including light absorbing particles such as carbon black or the material may contain a light absorbing dye. The light absorbing particles or dye may assist in heating the deformable polymer material if heated with light. Radiation absorbing particles may also include particles that effectively absorb microwave radiation. The magnetic particles may assist with actuation of the cells. The particle size may be in the submicron or nanometer range, but larger particles in the range of micrometers may be used in larger cells.

Cells do not necessarily need a membrane such as 20, but the membrane may protect the material in the cells, including in applications where the material protrudes beyond the surface of the cell walls. In applications without the membrane, the system may need to scrape off any protrusions and replenish the deformable polymer material. The membrane 20 may also include particles 22 similar to the particles in the deformable polymer material. The particles 22 in the membrane 20 may assist with abrasion resistance, such as in a silicone membrane with embedded titania nano-particles, or electrically conductive particles to allow electrostatic actuation. An example of electrically conductive particles may include carbon nanotubes that also allow the membrane to maintain flexibility while becoming conductive. Other examples include magnetic particles such as magnetite particles or particles that can be easily charged, e.g. by tribocharging. These would assist with actuation.

In another embodiment, the membrane 20 could take the form of a bimorph membrane. A bimorph membrane buckles when the deformable polymer material softens, causing actuation. The bimorph membrane should not return to its original position when the temperature drops, allowing the surface to form the print pattern. Buckling diaphragm actuators have been disclosed by Hirata, et al. "An Ink-Jet Head Using Diaphragm Microactuator," MEMS '96, IEEE Proceedings on the Ninth International Workshop on Microelectromechanical Systems, February 1996.

Figure 2:
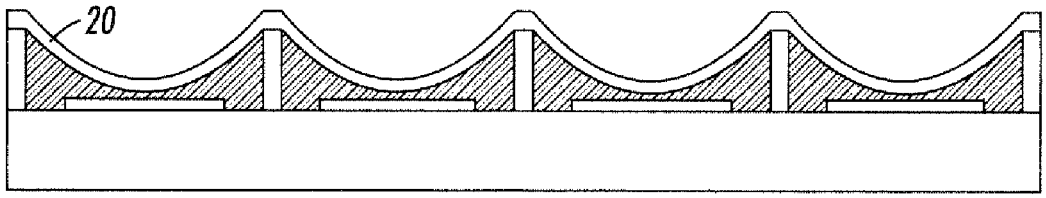
FIG. 2. shows an example of an array of cells having deformable polymer material in a deformed state.

The printing system may employ the deformable polymer material printing plate in several ways. FIG. 2 shows a portion of an embodiment of using the deformable polymer material printing plate. In FIG. 2, the process applies heat to the entire array of cells such as by a hot plate, a heating blanket, an array of microheaters on the substrate under the cells or in the cells, an infrared radiation source or other heat applicators. The deformable polymer material in all of the cells now softens or melts and the cells are subsequently actuated. When the cells are actuated, the membrane 20 deforms.

Actuation may occur in one of many ways. Actuation, used here, means the deformation of the surface of the deformable polymer material, whether in a negative aspect where the top surface deforms to form a dimple or a well, or in a positive aspect where the top surface deforms or 'bulges' to form a dome. Actuation may be internal, such as when the deformation occurs based upon the internal structure of the cells, for example, when the melted or softened polymer moves into a porous substrate or into channels in the substrate with no external force. Electrostatic actuation, where an electrode internal to the cell causes the membrane to deflect, would be considered internal actuation. Actuation may also be external, where an external, mechanical force is applied that causes the deformation. The surface may or may not include a membrane. Actuation methods include magnetic, electrostatic, either by individual actuation of an actuator in the bottom of each cell or by dipolar forces, mechanical force applied by a roller, spongy material or a liquid, positive pressure on the top surface pushing downward, negative pressure from the underside of the substrate sucking the cells down, positive pressure on the underside deforming the cells upwards, negative pressure on the top surface pulling the cells upwards, etc.

Figure 3:
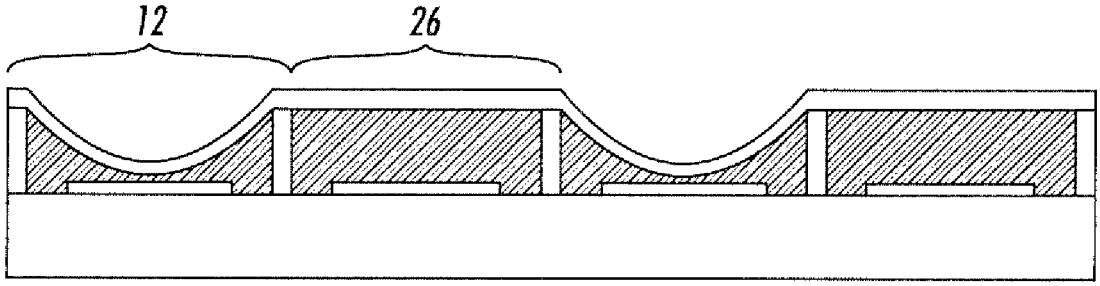
FIG. 3 shows an example of an array of cells forming a print plate.

In FIG. 2, all of the cells deflect downward. By decreasing the temperature the polymer in the cells solidifies and the array of cells with membrane 20 remains in this shape. In FIG. 3, the process applies heat to selected ones of the cells such as 26 to cause the cells to return to their undeformed state. At the same time a certain amount of heat may be applied to the whole plate in order to bring the polymer closer to its softening regime or to its melting point. The selectively applied heat energy, such as by a laser or a microheater or thermal printhead, can then be kept smaller. If the surfaces of the cells had deformed outward, the same result would occur when selected ones received heat.

Alternatively, after solidification the entire array could receive heat, with selected ones of the cells having their portions of the membrane electrostatically deflected. The solidification of the polymer upon cooling prevents the membrane or surface from resuming its undeformed state. The electrostatic deflection of the various regions may be accomplished with an active matrix backplane such as that used in liquid crystal displays. In this case, the active-matrix pixels would be patterned on the substrate and an electric field between a pixel pad and a conductive membrane 20 would cause a deflection of the membrane. In this manner, a printing pattern forms on the surface of the printing plate to allow wells to trap ink or raised areas to receive ink for subsequent transfer to a printing substrate. The printing pattern transferred to the printing substrate forms the print image.

Figure 4:
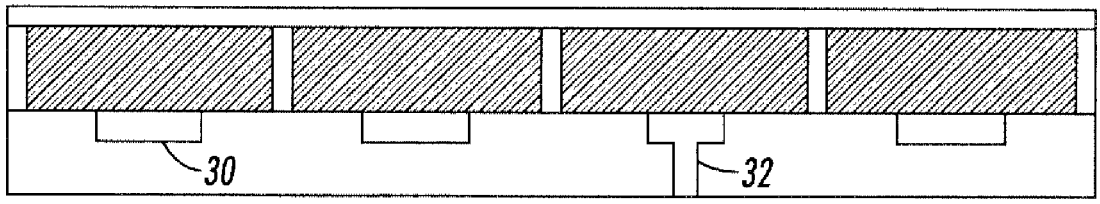
FIG. 4 shows examples of cells having reservoirs.
Figure 5:
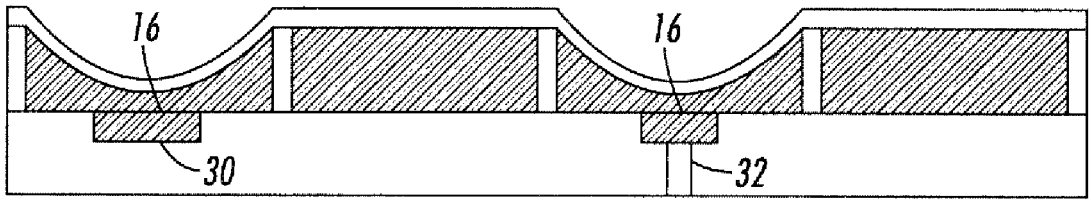
FIG. 5 shows examples of cells having reservoirs with deformable polymer material in a deformed state.

FIGS. 4 and 5 show another method for forming a printing pattern on the surface of the printing plate. This array differs from that shown in FIG. 1 in that it includes reservoirs for the deformable polymer material to occupy when the top surface deforms downward and therefore may comprise a more easily implemented embodiment due to the requirement for conservation of volume. The reservoir may have a simple well shape 30 that fills with the deformable polymer material 16 when actuated to deform downward as shown in FIG. 5. In this case the air or gas contained in the reservoir is being compressed.

The term reservoir, as used here, includes any structure in which molten deformable polymer material collects or accumulates until the material is moved out of it. The reservoir may collect molten material, 'store' it in solid form, and then have it removed from the reservoir when it is again molten, as an example. Reservoirs may include wells, channels or wells with low or high surface energy coatings, portions of a porous substrate, or any combination thereof, as examples.

In an alternative to a simple well reservoir, the reservoir may include or be a channel such as 32 that wicks the deformable polymer material into it without any external actuation. In this case it would be beneficial if the surface of the channel would possess a high surface energy so that the capillary forces are high. A surface coating in the channel such as a silane coating may be used to tailor the surface energy. Instead of one channel 32, the cell could also posses multiple channels. The channels may be etched into the substrate, e.g. by laser milling or commonly known dry or wet etching methods, etc. Further discussion may refer to this as an 'internal actuation' in that the deformable polymer material deforms without an external, mechanical force. As mentioned previously, any embodiment shown or mentioned here may include reservoirs, whether well reservoirs or 'wicking' reservoirs.

In the embodiment of FIGS. 4 and 5, the process forms a printing plate by selectively actuating cells, rather than deforming all the cells and then 'un-deforming' selected cells, or leaving the selected cells deformed. When the heat causes the deformable polymer material to soften or melt, in one embodiment, electrostatic forces may actuate selected ones of the cells. Other forms of internal actuation are possible, but may be more difficult to implement. In another embodiment, only selected cells receive heat, such as by the microheaters mentioned above. In one example of an array of microheaters, the microheaters consist of resistive elements. Each resistive element has an input port and an output port and is 'addressed' in a method similar to addressing any array of elements, through addressing transistors. To activate a heater, a first voltage is applied to the input port and a second voltage is applied to an output port, causing the resistive element to generate heat. U.S. Pat. No. 6,460,966 gives an example of microheater elements.

Another possible printing plate includes using a porous substrate. The substrate may allow passage of air, but not passage of the deformable polymer material. This would be used in a printing plate in which pressure is applied from under the substrate to push the deformable polymer upwards. When the deformable polymer returns back towards the substrate, the substrate acts as a stop for the material. The substrate may also allow for 'absorption' of the deformable polymer material to eliminate the need for a reservoir. The substrate could permanently absorb the material in the case of a disposable printing plate, but in a re-usable plate the substrate would allow the material to flow back out of the substrate into the cell.

Figure 6:
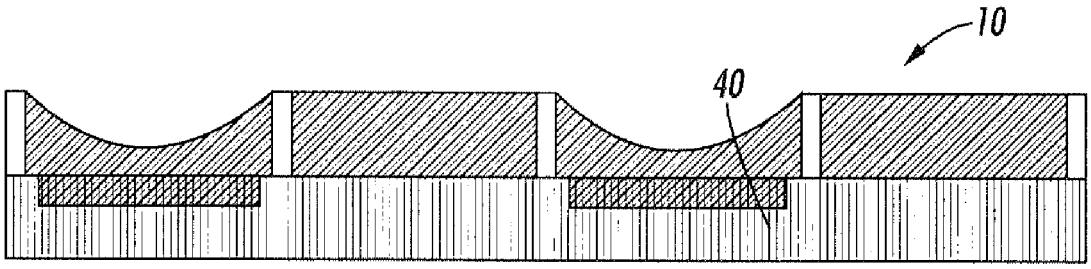
FIG. 6 shows an example of an array of cells on a porous substrate.

FIG. 6 shows an example of such a substrate have a region 40 into which the polymer is sucked when softened, and an array of cells 10 without a membrane. In the simplest case, the porous substrate could consist of a fibrous material such as paper. When the polymer in a cell is heated above its melting temperature, the porous substrate wicks the melted polymer as shown in area 40. Other porous materials such as described in US Patent Publication No. 2005191481 may be used. The substrate may also consist of porous metal which is typically made by sintering metal particles or it may consist of porous carbon or a porous ceramic. The pores in the substrate may also be etched with anisotropic etching techniques including deep reactive ion etching, laser milling and electrochemical etching. The diameter of the pores depends on the viscosity and the surface tension of the liquid and on the surface energy of the pores if they are small. Etched pores may be submicron in diameter up to several microns. Wider channel like reservoirs may be up to tenth of microns in diameter. [Julie, please only include this information if you think it could be useful and not too limiting.]

The porous material may be treated with surface modifiers such as silanes in order to adjust the surface energy. If the surface of the pores possesses a high surface energy, then the wicking action is improved due to higher capillary forces. If the surface energy of substrate pore surfaces is low, then a liquid will not be easily wicked into the pores. Once the polymer is pushed or wicked into the pores, it may be moved back into the cell by heating the polymer in order to turn it liquid again. By applying gas or fluid pressure from the bottom of the substrate or by applying a vacuum at the top surface the liquid polymer moves back into the cells. This reversal is likely to work best if the pores are straight columns with a relatively large diameter and with smooth walls so that the probability of polymer trapping in corners or crevices is low.

Many materials may undergo heating and then be wicked by an absorbent material. For example, U.S. Pat. Nos. 3,264,103, 5,015,556, and 5,279,697, show materials that are wicked from a heated surface of a material that softens upon heating. However, the material that softens is only the 'uncured' portions of the material, and the wicking is performed by pressing an absorbent material on the heated, uncured portions for removal.

Figure 7:
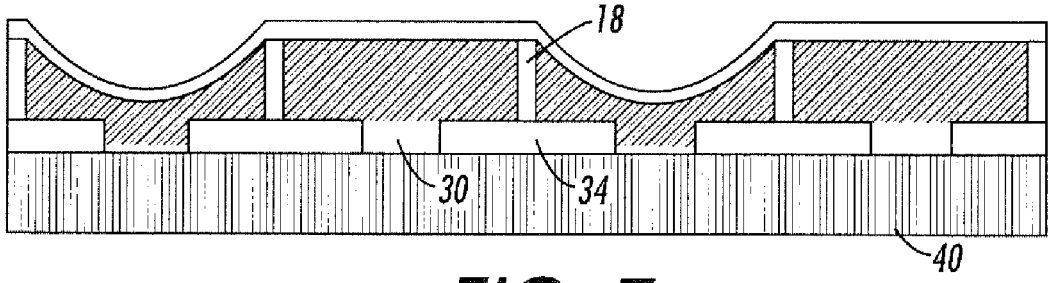
FIG. 7 shows an alternative example of an array of cells on a porous substrate.

In yet another alternative, FIG. 7 shows a combination of a porous substrate, with an additional layer. The deformable polymer material is localized by the spacers or walls such as 18. Underneath the deformable polymer material is a reservoir layer 34, in which are formed the wells 30. FIG. 7 shows a single well per cell, but multiple wells 30 per one cell are also possible. The reservoir layer 34 in turn resides on a porous substrate. When molten, the polymer material will move into the wells, either by an external force such as positive pressure applied to the membrane or a vacuum applied to the underside of the substrate, or by capillary forces between the fluid and the surface of the wells 30. In this embodiment the melted polymer does not move into the porous substrate and therefore the refreshing of the printing plate by moving the polymer back into the cells can be done more reliably. The porous substrate merely provides a rigid substrate through which gas (air) can pass. However, instead of air, also a low viscosity fluid, such as water, a low-viscosity silicone oil, low-viscosity fluorinated liquid, e.g. Fluorinert™, etc., may be used to transfer the actuation pressure.

Figure 8:
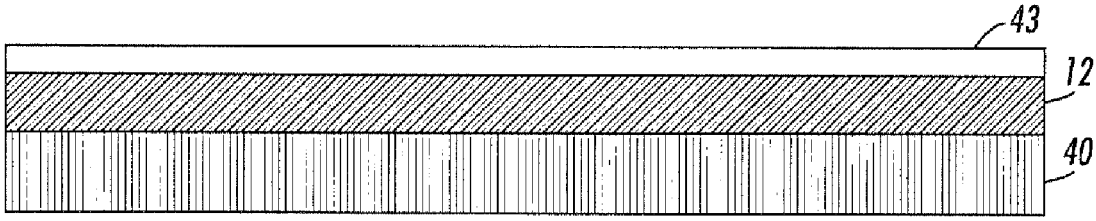
FIGS. 8-10 show an example of an array of cells without walls used as a printing plate.
Figure 9:
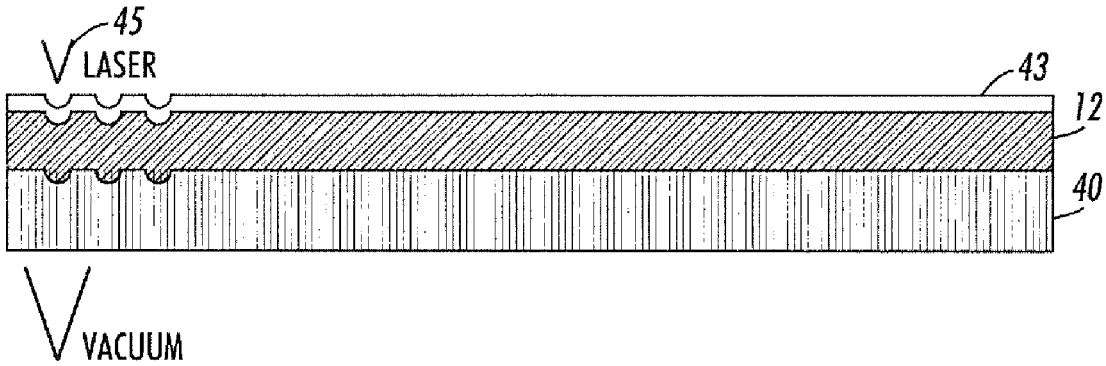
Figure 10:
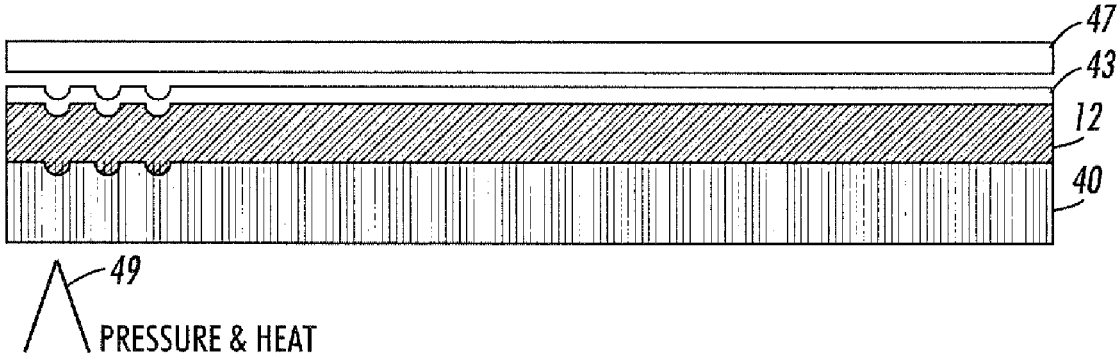

In addition to variations of the reservoir structure and/or using or not using a membrane, the printing plate may or may not use a spacer/wall structure such as 18 of FIG. 7. FIGS. 8-10 show an embodiment of a printing plate without walls.

In FIG. 8, the polymer material 12 is layered on a porous substrate 40. The polymer layer may have been attached to the porous substrate layer by pressing the two layers together and slightly heating both. As the polymer softens it becomes tacky and a bond between the polymer and the porous substrate forms. During this fabrication step excessive heating has to be avoided, otherwise the polymer may wick into the pores of the substrate. A membrane 43, which may be an elastic material such as PDMS (polydimethylsiloxane, also referred to as silicone) or a polyurethane or other rubbery materials may or may not be used. The membrane materials may be deposited by sheet lamination or by a liquid coating technique such as spray coating extrusion, dip coating, etc.,) and subsequent cross linking or solidification.

In FIG. 9, localized heating of the polymer material occurs. In embodiments without walls to define the cells, the cells consists of the localized regions. The localized regions correspond to picture elements, or pixels, in the print image. As shown, heat may come from the laser 45, or the array of microheaters discussed earlier. Use of a laser, such as the raster-scanning lasers used in printing, may be more familiar. Other focused light sources may be used as well, such as spatial light modulators, arrays of individual light valves that selectively transmit or do not transmit light to a surface. One example is the Digital Micromirror Device™ manufactured by Texas Instruments as the basis for the Digital Light Processing® technology. The combination of a modulator with appropriate focusing optics would constitute a focused light source.

The localized region of polymer material forming the cell under the laser spot melts and collects in the porous substrate. This may result from application of a vacuum to the backside of the substrate, a positive pressure to the top of the membrane or material, or may occur 'automatically' due to capillary forces between the liquid polymer and the substrate. In a similar way bumps may be formed on the surface.

In this case, pressure is applied to the backside of the substrate and when a region of the polymer is heated, the polymer is forced upwards and a bump forms. At the interface to the substrate an air pocket will remain. The surface topography generated in the manner shown in FIG. 9 may then be used to transfer ink to another surface. In one example the generated grooves or dips shown in FIG. 9 may hold the ink such as in a gravure plate. In another example the ink may only sit on the raised areas similar to a flexography plate.

In FIG. 10, a plate 47 is introduced on the membrane side of the printing plate. This plate is used to refresh the printing plate and turn it ready for a new print pattern. The plate 47 is pressed against the surface of the printing plate and it provides a planar surface. Pressure and heat may then be applied from the backside of the substrate to reverse the dips or grooves in the surface of polymer layers 12 and 43. Without plate 47 the softened or melted polymer layer 12 would be lifted off the substrate.

Figure 11:
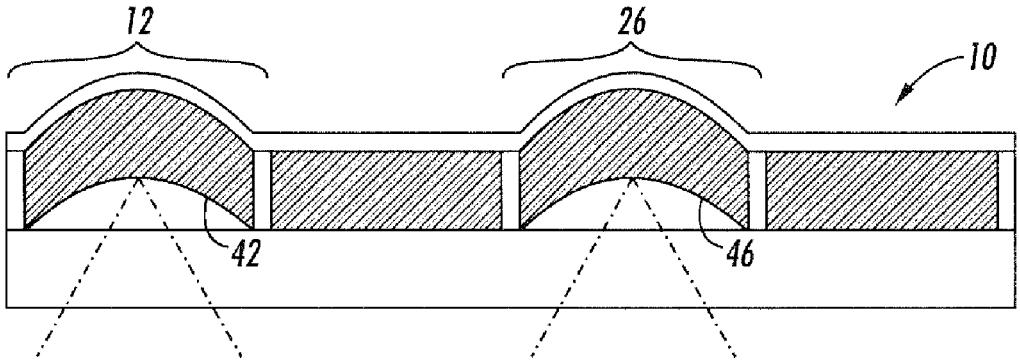
FIG. 11 shows an example of cells deforming in a protruding state.

In FIG. 11, pressure from the back side of the substrate causes the polymer material in cells 12 and 26 to push away from the substrate such as shown at 42 and 46, respectively. Here the substrate is again a porous substrate, or a substrate with through holes or capillaries which provide a path for gas or fluid from one side of the substrate to the other side. The applied pressure may be due to air or gas pressure or it may be caused by a liquid which can penetrate the substrate. A liquid such as water or low viscosity oil may be examples for such a liquid. Due to the pressure, the polymer in the heated cells deforms and as the polymer material bulges out, the membrane or the top of the polymer material, forms bumps.

Controlling the pressure or the heating time or heating power used for each cell may modulate the distance the membrane deflects. Variation of the distances may correspond to gray scale in flexographic printing because different height bumps may pick up different amounts of ink and the dot gain during printing will be also different. However, the height difference must be within the range of elastic deformation of the bumps during the printing process, otherwise the recessed bumps would not make contact to the transfer surface. Indeed, variation of the distance (bump height or pit depth) in any of the methods discussed may control gray scale in printing, whether by pressure, electrostatic attraction, mechanical force, etc. In addition, controlling of the heating with regard to returning the 'undeformation' of the bumps can also achieve the variations in the distance.

In comparison, then, many different methods can form the printing pattern on the printing plate. In on approach, the entire array of cells is heated and deforms upon application of an external force. After cooling this state of the printing plate is stored or 'frozen' in. Then selected or 'unselected' ones of the cells are 'undeformed' and returned back to their planar state by selectively applying heat such as via a laser, and an opposite force.

In another approach, the entire array of cells is heated, but only selected ones are actuated for deformation. In yet another approach, only selected ones of the cells are heated such as by an array of microheaters or a scanning laser. These selectively heated cells then deform due to application of an external force. The external force may be caused, for example, by air/gas or fluidic pressure applied to the top or the bottom surface of the printing plate or by a magnetic field acting on magnetic particles in the cells or in the membrane covering the cells. Whichever approach used, it results in a print pattern formed on the printing plate for eventual inking and transfer to a print substrate as the print image.

An advantage of this type of printing plate is its reusability. Once the printing process has completed the print job using the current printing pattern, the entire plate can be heated and returned to its planar or undeformed state in preparation for receiving a new printing pattern. In typical gravure and flexographic printing, the plates are formed from patterning and etching processes that are permanent and do not allow for reusability of the plate with a new printing pattern. Of course, if the printing plate can be manufactured inexpensively enough, it may also be provided as a single-use material, e.g. on a supply roll. In this case, the pattern is written once and after the print cycle the 'plate' is discarded and new material is loaded.

Figure 12:
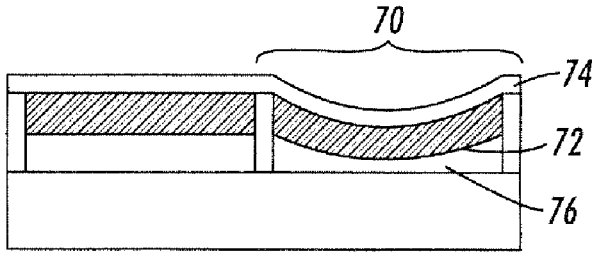
FIG. 12 shows an example of a transfer surface.

An alternative to a well-type reservoir or channel, where the substrate contains the reservoir, is shown in FIG. 12. The cells 70 could have a bottom membrane 72 made of a polymer that softens and becomes plastically deformable upon heating and an optional top membrane 74. Between the bottom membrane and the substrate there is a gap 76. When the polymer membrane material 72 softens upon heating, it would deflect upwards or downward depending on the direction of the applied force.

The plate in FIG. 12 could be fabricated by simply laminating a polymer sheet 72 onto underlying substrate with the cell walls. The cell walls have to be higher than the thickness of the polymer sheet so that a gap 76 remains. Here the polymer 72 would not be heated to its melting point but only above its Tg (glass transition temperature) so that the material easily plastically deforms when a force is applied. In one example the cells have a pitch of 30 microns with ~5 micron wide cell walls and a thickness of the membrane 72 between ~1 and 10 microns. The height of the cell walls would be chosen to allow at least 5-10 microns downward deflection of the membrane. The top membrane 74 may consist of a thin layer of an elastomer such as a silicone or polyurethane, for example. The substrate or the walls may provide venting channels. For example, the substrate may be porous or it may have channels etched in it to let air or liquid pass in and out of the gap.

One concern that may arise involves wear and tear on the printing plate. In gravure and flexographic printing, a stamping type of process uses the printing plate numerous times. In some instances, the plate may have a low enough cost to be disposable. A low-cost plate may allow the use of a permanently hardening polymer, or thermoset polymer. Such polymers may be cross-linked by heat or irradiation which turns them permanently more rigid. Typically 'deformable polymer' describes materials that change phases between liquid and solid repeatedly. Hardening polymers, such as an ultraviolet curable polymer, change phases only from liquid or soft to solid or hard. They do still change phases and the term 'deformable polymer material' used here will include UV or other curable polymers.

Figure 13:
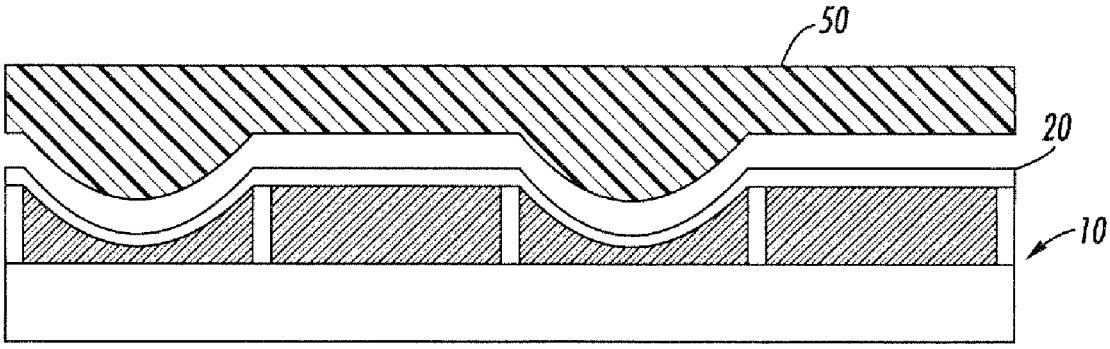
FIG. 13 shows an alternative embodiment of a cell.

In some instances the plate may have a high value, due to the complexity of the process of creating a printing plate out of the actuated surface. Therefore, it may be undesirable to expose the plate surface to the forces involved in the ink transfer and to contaminate the surface with printing ink. In this instance, shown in FIG. 13, a curable, transfer material including a liquid 50 may allow transfer of the printing pattern to preserve the plate surface. Examples of materials that can be used as the transfer material include photocurable polymers, dual-component polymers, multi-component polymers, and thermoplastics. Amongst those materials are epoxies, polyurethanes, acrylics, silicones, for example. A more specific example would be the UV cure resins DC7165 or 60-7010 from Epoxies, Etc. of Cranston, R.I.

The transfer material contacts the array of cells 10 in a softened or preferably liquid form to allow the transfer material to assume the topology of the printing plate as formed by membrane 20. The transfer material is then cured or hardened to form a transfer surface. The curing may occur for example by irradiation with UV light or other cross-linking methods or hardening may occur by a simple phase-transition from a liquid to a solid state due to a temperature change. Of course, the melting temperature of the material 50 would have to be below the glass transition temperature of the polymer used in the underlying cells. The hardened transfer surface is peeled off the actuated master plate and then it acts as the printing plate.

The material 50 may be of course attached to a solid substrate which is not shown in FIG. 12. The solid substrate may be for example a thin polymer foil, such as a Mylar foil, a metal foil or a sheet of glass. In order to enable an easy release of the hardened material 50 from the surface or membrane 20, a release coating may be applied to the membrane 20 before the process. Examples of release coatings are silanes, fluorinated polymers, silicones and silicone oils. The printing plate may also act as a master for several curable, transfer surfaces with minimal wear on the printing plate. The hardened material 50 may also be chosen to have rubber-like elasticity as required for flexographic printing plates.

deformable polymer. In this manner, a deformable polymer material allows many different structures and methods for gravure or flexographic printing. The deformable polymer material also allows different methods of actuation and addressing with varying levels of complexity.

It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A printing plate, comprising:

a substrate;

an array of cells on the substrate, wherein each cell corresponds to an element of a print image;

a solid deformable polymer material localized into the cells such that each cell is formed by spacers and contains the deformable polymer material;

a reservoir corresponding to each cell arranged to collect the deformable polymer material from the cell as needed when the deformable polymer material is one of either melted or softened;

and an actuation mechanism configured to cause the deformable polymer material to deform in selected cells such that at least some portion of the deformable polymer material moves into the reservoir when deformed, wherein a surface of the deformable polymer material in the cells forms a printing surface.

2. The printing plate of claim 1, the printing plate being one of either a gravure plate or a flexographic plate.

3. The printing plate of claim 1, the printing plate comprising a deformable membrane on the deformable polymer material, wherein the membrane is arranged to deform with the deformable polymer material to form the printing surface.

4. The printing plate of claim 3, wherein the membrane comprises one of an electrically conductive material, a membrane including magnetic particles, a membrane including light-absorbing particles, a membrane including embedded carbon nanotubes, and a bimorph membrane.

5. The printing plate of claim 1, the printing plate comprising an array of actuators such that each cell contains at least one actuator.

6. The printing plate of claim 1, the actuation mechanism comprising at least one of: light absorbing regions, addressable heater elements, electrodes, or magnet actuators.

7. The printing plate of claim 1, wherein the reservoir comprises one of a region of a porous substrate, a well reservoir, or a high surface energy channel.

8. The printing plate of claim 1, wherein the deformable polymer material comprises one of a thermoplastic polymer, a thermoplastic polymer embedded with radiation absorbing particles, a thermoplastic polymer embedded with dye, or a thermoplastic polymer embedded with magnetic particles.

* * * * *